United States Patent [19]

Knapp

[11] Patent Number: 5,014,919

[45] Date of Patent: May 14, 1991

[54] SMALL HAND-HELD SHOWER HEAD FOR DOMESTIC SINKS CONNECTED TO A FAUCET

[75] Inventor: Alfons Knapp, Biberach/Riss, Fed. Rep. of Germany

[73] Assignee: Masco Corporation, Taylor, Mich.

[21] Appl. No.: 477,906

[22] PCT Filed: Jul. 24, 1989

[86] PCT No.: PCT/US89/03187

§ 371 Date: Apr. 18, 1990

§ 102(e) Date: Apr. 18, 1990

[87] PCT Pub. No.: WO90/00935

PCT Pub. Date: Feb. 8, 1990

[51] Int. Cl.[5] ..... B05B 1/30

[52] U.S. Cl. ..... 239/579; 239/530

[58] Field of Search ..... 239/530, 574, 576, 579, 239/588

[56] References Cited

U.S. PATENT DOCUMENTS

| | | | |
|---|---|---|---|
| 623,128 | 4/1899 | Bartlett | 239/579 |
| 1,550,305 | 8/1925 | Dreischerf | 239/579 |
| 1,727,962 | 9/1929 | Buskard | 239/588 |
| 2,457,993 | 1/1949 | Fletcher | 239/579 |
| 2,684,268 | 7/1954 | Hjulian | 239/579 |
| 3,219,278 | 11/1965 | Santarelli | 239/579 |
| 3,227,321 | 1/1966 | Sagarin | 239/579 |
| 3,637,143 | 1/1972 | Shames et al. | 239/530 |
| 3,754,709 | 8/1973 | Laatsch | 239/530 |
| 4,128,209 | 12/1978 | Johnson | 239/530 |

FOREIGN PATENT DOCUMENTS

| | | | |
|---|---|---|---|
| 1061947 | 4/1954 | France | 239/579 |
| 2536774 | 6/1984 | France | 239/530 |
| 438467 | 11/1935 | United Kingdom | 239/579 |

*Primary Examiner*—Andres Kashnikow
*Assistant Examiner*—Michael J. Forman
*Attorney, Agent, or Firm*—Myron B. Kapustij; Edgar A. Zarins; Malcolm L. Sutherland

[57] ABSTRACT

A hand-held shower head, commonly called a vegetable spray, for domestic sinks having a tubular handle member (1) connectd to the water supply via flexible piping. A jet breaking or aerating spray head of the shower is axially and slidably mounted on the tubular stem which creates a seal. This spray head is connected through an internal stick (8) to a valve element (9) which cooperates with a valve seat (2) that is in the tubular stem between the valve element and the spray head. A spring (12) is preferably placed between the spray head and a ledge (2) which forms the valve seat for the valve element. Preferably, the valve element (9) is a separate member from the connecting stem and has an undercut seat (10) for receiving a sealing gasket (11). The gasket (11) can be inserted into this undercut seat (10) when the valve element (9) is separated from the connecting stem (8), but cannot be taken out again when the connecting stem is fixed to the valve head.

1 Claim, 1 Drawing Sheet

SMALL HAND-HELD SHOWER HEAD FOR DOMESTIC SINKS CONNECTED TO A FAUCET

TECHNICAL FIELD

The present invention relates to a hand-held spray for domestic sinks, and in particular, a small hand-held spray which is adapted for use in association with a faucet that incorporates a diverter valve.

BACKGROUND OF THE INVENTION

Small shower heads for residential sinks, commonly called vegetable sprays, have a tubular handle member connected to the water supply via flexible piping and terminating with a jet breaking or aerating spray head. A valve, which is operably mounted in the tubular stem, is normally closed to the flow of water but it can be open upon actuation. The valve remains open only as long as the valve is actuated and it closes automatically at the end of being actuated. When the valve is open, water spray is emitted from the spray head. A shower head of this type can be directly connected to the water supply, but usually it is connected to a mixing faucet which has a diverter valve mounted therein which feeds both the shower head and the spout of the faucet. The diverter is a device which is usually mounted in a faucet and which is made in such a way that it normally supplies water to the spout when the shower head valve is closed but supplies the shower head when the shower head valve is actuated. With this arrangement, normally water flows through the spout but as soon as the user actuates the valve of the shower head, water flows through the shower head to the exclusion of the spout.

Among the known embodiments, the internal valve which is on the tubular stem of the small shower head is actuated by means of an actuation lever that is manually activated. The use of an actuation lever minimizes the force needed to activate the valve. When pressed, the lever provides for the opening of the valve that permits water to flow through the shower head. A shower head of this type does not require great pressures and the activation of its valve requires a significant force only if the supply pressure is at an unusually high level. The force required is minimal when the supply pressure is limited, for instance, when the shower head is fed through a diverter valve. On the other hand, the utilization of a lever regulated actuation system requires a considerably complicated construction and therefore, the cost of manufacturing and mounting is high and problems can occur relatively easily.

What is needed is a small hand-held shower head for association with a faucet and residential sink adapted for low supply pressure and particularly for a water supply through a diverter valve that has great structural simplicity and therefore results in low cost and trouble free maintenance.

SUMMARY OF THE INVENTION

According to the invention, a spray head of the small hand-held shower head is axially slidably mounted on a tubular handle. A seal is interposed between the shower head and handle. The shower head is connected through an internal stem to a valve element which cooperates with a valve seat in the handle. The valve seat is positioned between the valve element and shower head.

The flow through the small hand-held shower head is normally blocked by the fact that the valve element is pushed by the water supply pressure to make a seal on the valve seat. It is sufficient to manually apply pressure to the shower head so that it moves the valve head upstream away from the valve seat thus allowing the water to flow through the valve seat about the stem and through the small hand-held shower head. In this way, the construction of the hand-held shower becomes extremely simplified allowing the total absence of levers. Furthermore., the possibility that functional problems will occur is practically eliminated. The functioning of the small hand-held shower becomes extremely easy because it only requires the user to exert a pressure on the shower head with one finger of the hand that is holding the shower head. In this way, by using only one finger, enough pressure can be obtained as long as the feeding pressure of the shower head is limited. This condition is also true when the shower head is connected directly to a low pressure aqueduct, and in particular, it is always true when the shower head is fed (even when it is fed by an aqueduct of elevated pressure) through a kitchen diverter valve because in this case, the pressure applied to the shower head is never more than the pre-established back pressure that is able to successfully operate the diverter valve.

The shower head is pushed toward the closed or off position by the supply pressure, but preferably, a resilient member, for example a spring, is placed between the tubular handle and the shower head so that the shower head is biased toward the closed or off position.

BRIEF DESCRIPTION OF THE DRAWINGS

Reference now will be made to the accompanying drawings in which.

DESCRIPTION OF THE PREFERRED EMBODIMENT

Figure 1:
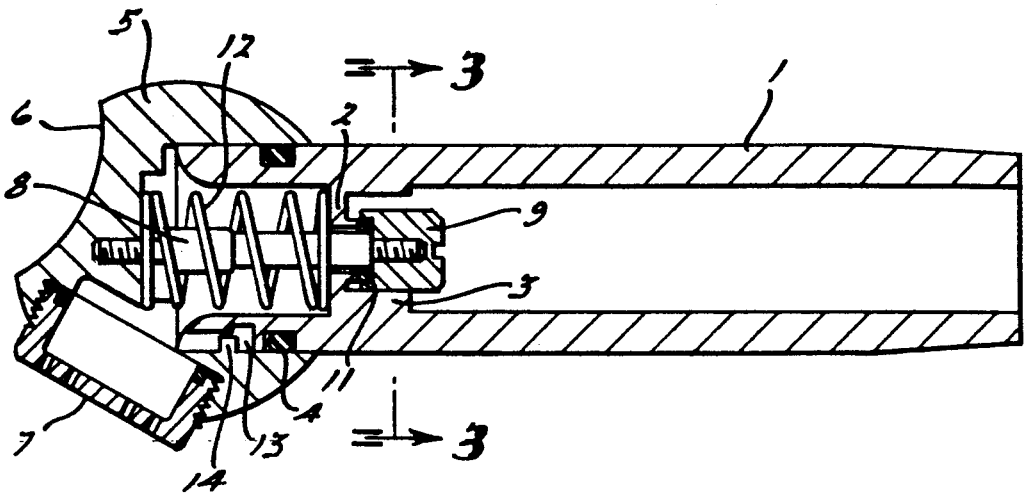
FIG. 1 is an axial cross-section view of a hand-held shower head according to the invention shown in the off position.

The small hand-held shower has a tubular shaft or handle 1 which is constructed to be connectable to flexible piping (not shown) that is connected to a water supply. The tubular shaft 1 is preferably connected via the flexible piping to a mixing faucet with a diverter valve therein. This tubular shaft 1 has an integrally formed shoulder 2, the upstream end forming a valve seat. Also, the shaft 1 has some guiding fins 3 upstream of the valve seat. The tubular shaft 1 has an external seat for receiving an annular sealing gasket 4. A shower head 5 is mounted for axial sliding and limited rotation on the tubular shaft 1. The shower head 5 and shaft 1 are sealed by the gasket 4. The shower head 5 can, for example, be substantially spherical except for a notch 6 at the distal end which the user can manually press a finger or thumb thereagainst to apply pressure to activate the shower head. The shower head 5 has a spray outlet 7.

Figure 2:
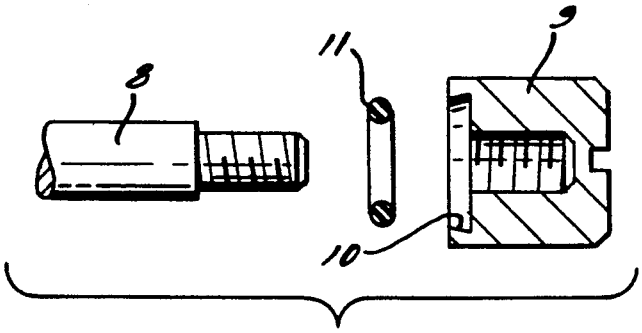
FIG. 2 is an exploded detail of the valve element, seal and stem.
Figure 3:
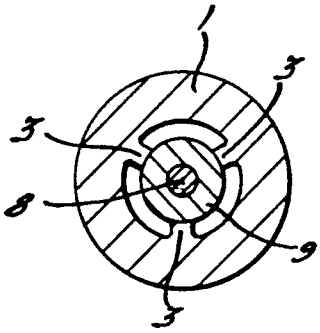
FIG. 3 is a cross-section view taken along line III—III shown in FIG. 1.

One end of the stem 8 is threadably connected to the shower head 5. The stem 8 passes through the valve seat of the shoulder 2 within the tubular shaft 1. At the other end of the stem 8, a valve element 9 is threadably connected thereto as shown in detail in FIG. 2. The valve element 9 has a recess 10 that receives a gasket 11 adapted to cooperate with the valve seat of the shoulder 2. A compression spring 12 is interposed between the shower head 5 and the shoulder 2 of the tubular stem 1 and biases the shower head toward the position seen in FIG. 1 in which the valve element 9 is biased with its gasket 11 against the valve seat of shoulder 2 such that the water flow is shut off.

Figure 4:
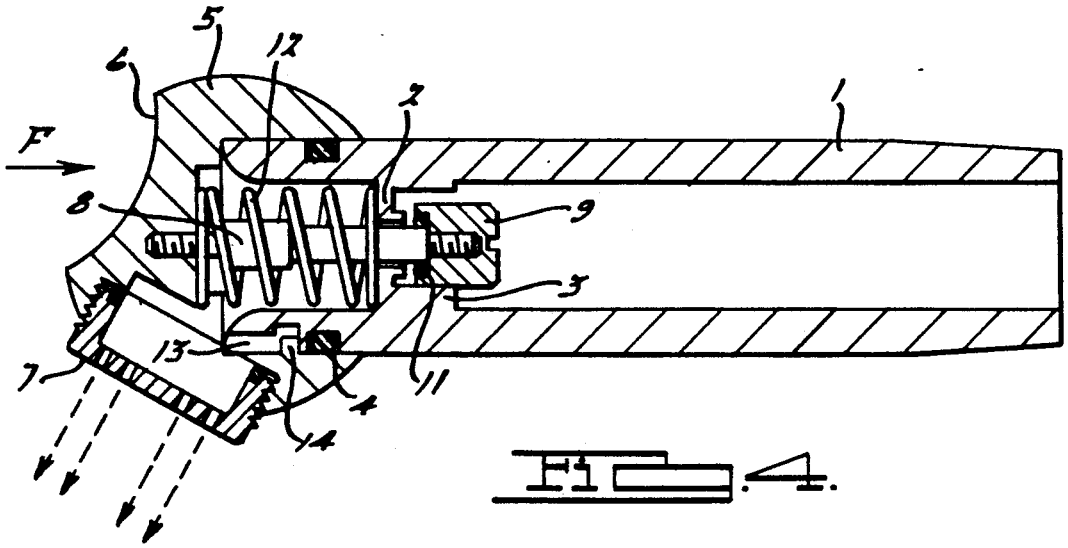
FIG. 4 is a view similar to FIG. 1, but with the shower head shown in the on position.

If the user, with one finger of the hand that is holding the shower head, applies pressure to the shower head 5 via notch 6 in the direction of arrow F of FIG. 4, the shower head 5 then can slide on the tubular shaft 1 against the bias of the spring 12 and of the hydraulic pressure which acts on the valve element 9. Thus, the gasket 11 is moved away from the valve seat of shoulder 2 such that the water lows through the shower head to the spray outlet 7. As soon as the user stops applying pressure F, the combined bias of the spring 12 and the hydraulic pressure on the valve head 9 jointly slides the shower head 5 and the valve head 9 in the direction opposite to the arrow F. This also causes the gasket 11 to compress against the valve seat of shoulder 2, and thus stops the flow through the shower head. In the cases in which the action of the water supply pressure on the valve element 9 is enough to cause closure, the spring can be omitted.

If it is desired to have a spray that can remain on without a thumb or finger constantly pressing against shower head 5, an optional bayonet slot 13 can be put into one end of the shaft 1 and an optional fixed pin 14 of the shower head can extend into the bayonet slot. A simple rotation of the shower head 5 in the depressed position can lock the shower in the on position shown in FIG. 1.

The valve element 9 solves a problem in the mounting of the sealing gasket 11 on it. The manufacturing of the appropriate seat for this gasket 11 would be somewhat difficult if the valve element 9 and the stem 8 were only one piece. Furthermore, the action of the water supply pressure would tend to separate the gasket 11 from the valve head 9 if the gasket valve were not correctly stabilized. In order to facilitate the manufacturing and to realize an operation of definitive stabilization, the invention requires that the valve element 9 is a separate member from the stem 8. The valve element 9 has an undercut seat 10. The invention also requires that in this seat 10, the sealing gasket 11 and the stem 8 are given dimensions in such a way that the gasket 11 can be easily inserted into the undercut seat 10 while the valve head 9 is separated from the stem 8. Further, the insertion of the stem 8 inside the gasket 11 impedes the abnormal passage of the gasket 11 from the undercut seat 10. The connection between the stem 8 and the valve head 9 can be advantageously realized through screwing them together. In this way one can obtain an efficient functional assembly of the gasket 11 to the valve head 9, thus making the operation of mounting and eventual dismounting of the parts much easier.

As it can be understood, the pressure according to the arrow F can be created with one finger of the user. This pressure is not very great and therefore would not be sufficient to overcome highly elevated hydraulic pressure that is applied to the valve element 9. According to the invention, the shower head is adapted for low pressure supplies which can always be obtained even when the incoming aqueduct has high pressure but where a mixing faucet is provided with a diverter valve.

Variations and modifications of the invention are contemplated without departing from its spirit as defined in the appended claims.

The embodiment in which an exclusive property or privilege is claimed is defined as follows:

1. A small hand-held shower for residential sinks comprising:

a tubular shaft constructed to be connectable at one end to a pressurized water supply through flexible piping;

a shower head mounted at an end of said tubular shaft opposite said end at which said shaft is connectable to a water supply;

said shower head being substantially spherical and having a notch at its distal end so that it can be activated by a finger of a user's hand that is holding the shower;

a valve mounted in said tubular shaft which is normally closed to the flow of water and manually actuated to an open position and constructed to be automatically closed by itself when actuation forces are removed;

the shower head being slidably mounted and sealed on the tubular shaft and being connected through an internal stem to a valve element which cooperates with a valve seat formed by an internal shoulder in the tubular shaft located intermediate the valve element and shower head;

the valve element being removably mounted on said internal stem;

said valve element having an undercut seat to hold a sealing gasket;

said undercut seat, sealing gasket and internal stem being dimensioned such that the sealing gasket can be inserted into the undercut seat while the insertion of the internal stem impedes the abnormal passage of the gasket from its seat; and a compression spring located between the shower head and the valve seat which biases the shower head toward an off position.

* * * * *